US005125515A

United States Patent [19]

Bushman et al.

[11] Patent Number: 5,125,515

[45] Date of Patent: Jun. 30, 1992

[54] FRUIT SIZING APPARATUS

[75] Inventors: Ronald C. Bushman, Brea; William E. Harris, Jr., Glendora, both of Calif.

[73] Assignee: Brown International Corp., Covina, Calif.

[21] Appl. No.: 616,863

[22] Filed: Nov. 21, 1990

Related U.S. Application Data

[63] Continuation-in-part of Ser. No. 381,504, Jul. 18, 1989, Pat. No. 4,978,010.

[51] Int. Cl.[5] ..... B07B 13/05

[52] U.S. Cl. ..... 209/663; 134/129; 134/181

[58] Field of Search ..... 209/663, 660, 661, 659, 209/621, 622, 668, 667, 665; 134/129, 180, 181

[56] References Cited

U.S. PATENT DOCUMENTS

| | | | |
|---|---|---|---|
| 1,019,341 | 3/1912 | McIntosh | 209/663 |
| 1,145,079 | 7/1915 | Parker | 209/663 |
| 1,257,017 | 2/1918 | Parker | 209/663 |
| 1,293,175 | 2/1919 | O'Quinn | 209/663 |
| 1,293,176 | 2/1919 | O'Quinn | 209/663 |
| 1,403,597 | 1/1922 | Evans | 209/663 |
| 1,643,190 | 9/1927 | VonCanon | 209/663 X |
| 1,647,812 | 11/1927 | Raun | 209/668 X |
| 1,651,847 | 1/1928 | Stebler | 209/663 |
| 1,882,038 | 9/1928 | Roberts et al. | 209/663 |
| 2,243,516 | 5/1941 | Wayland | 209/663 |
| 2,316,159 | 9/1943 | Evett | 209/620 |
| 2,425,478 | 9/1944 | Lawton et al. | 209/668 |
| 2,719,529 | 10/1955 | Wells | 134/181 |
| 3,713,537 | 1/1973 | Walter | 209/665 X |
| 4,978,010 | 12/1990 | Bushman et al. | 209/663 |

FOREIGN PATENT DOCUMENTS

| | | | |
|---|---|---|---|
| 3366/26 | of 1927 | Australia | 209/663 |
| 1473796 | 4/1966 | France | 134/181 |
| 447499 | 3/1968 | Switzerland | 134/181 |

*Primary Examiner*—Donald T. Hajec
*Attorney, Agent, or Firm*—Lyon & Lyon

[57] ABSTRACT

A fruit sizing apparatus includes a guideway having an inclined surface extending from a base to a peak with a first channel adjacent to the peak and a second channel adjacent to the base. First and second endless moving belts are supported in part by the first and second channels respectively. The first and second belts are driven at different speeds. A roller is spaced apart from the guideway and rotates in a direction tending to cause fruit to roll up the inclined surface. Additional belts can be provided for improved performance. A washing system over the apparatus cleans the apparatus using fan sprays of water.

1 Claim, 5 Drawing Sheets 30
52
54
56
58
32
60
62
26
42
44
46
15
70
d
65°
35°
72

FRUIT SIZING APPARATUS

BACKGROUND OF THE INVENTION

This application is a continuation-in-part of U.S. patent application Ser. No. 381,504, filed Jul. 18, 1989 and issued as U.S. Pat. No. 4,978,010.

The present invention relates to an apparatus for sorting fruit by size.

It is often necessary or desirable to sort fruit by size. For example, with the manufacture of orange juice, the oranges to be processed into orange juice must be sorted into, e.g., five different size groups, with each size group processed by different juice extraction machinery. Juice extractors typically include cups for holding the fruit while it is sliced in half and then reamed or squeezed to extract the juice. However, to efficiently extract juice from the fruit, the cup size must be approximately matched to the size of the fruit being processed.

Certain disadvantages may arise when the fruit size is not properly matched to the cup size of the juice extraction machinery. One disadvantage is that due to the size mismatch, all of the available juice within a fruit may not be extracted, resulting in a loss of a portion of the available juice. In addition, with such a size mismatch the rind of the fruit may be unintentionally engaged by a reamer or otherwise crushed or ruptured, thereby releasing bitter fruit oils and other undesirable peel components from the rind which mix with and degrade the quality of the extracted juice. A mismatch may occur when a small fruit is inadvertently carried to a large size juice extractor or conversely when a large fruit is inadvertently directed into a small size juice extractor.

Previous fruit sizers such as those utilizing flat conveyor belts have met with varying degrees of success. However, they have several inherent disadvantages. One such disadvantage is the inability of known fruit sizers to consistently size fruit and prevent small size fruit from inadvertently being carried along with larger fruit to a large size fruit juice extractor. This disadvantage typically arises when a small size fruit is surrounded by larger fruit on the flat conveyor belt such that the small fruit is sandwiched and carried along with the larger fruit. As previously described, this may result in reaming of the fruit rind in a large size fruit extractor and the subsequent degradation of juice quality by virtue of the released fruit oils and other undesirable peel components.

In addition, existing fruit sizers having flat conveyor belts require a substantial travel length in order to separate the fruit and sort it by size. These known sizers are large and bulky and require heavy structural members and frames. As a result, they are expensive to build and maintain. Their large size and flat belt configuration also makes them difficult to clean. Typically, cat-walks are provided along both sides of the length of these known sizers because their large width prevents sufficient access for cleaning from one side only. Moreover, varying the spacing between the flat belts and the rollers, to adjust for fruit size, tends to be difficult and time consuming with these sizers, due to the large number of individually driven rollers.

In operation, the motion imparted to the fruit by the flat belt and rollers in these known devices does not always sufficiently break up clusters of fruit, such that small fruit may be carried along with larger fruit to a large size fruit juice extractor, leading to degradation of fruit juice quality. The moving flat belts of these known fruit sizers may also tend to "throw" fruit forward causing the fruit to overshoot the appropriate sizing station.

Accordingly, it is an object of the invention to provide a fruit sizing apparatus which effectively sorts fruit by size.

It is the further object of the invention to provide such an apparatus which is compact and relatively lightweight.

It is the further object of the invention to provide such an apparatus which is relatively easy to clean and to adjust.

It is yet another object of the invention to provide such an apparatus that effectively breaks up clusters of large and small fruit to maintain high quality juice extraction.

Other and further objects will appear hereinafter.

SUMMARY OF THE INVENTION

To this end, an apparatus for sorting fruit by size includes first and second spaced apart belts and a guideway for supporting the belts. A roller is positioned above the guideway and rotates to generally urge fruit from the second belt to the first belt. The first and second belts move along the guideway at different speeds. Preferably, the first belt is positioned near the top of the guideway and moves from 10 to 90% faster than the second belt which is positioned along the base of the guideway. The guideway most preferably has two inclined surfaces and semi-circular channels at the top or peak of the guideway, and along the base of the guideway, to support the moving belts.

In a preferred embodiment, the roller is an assembly of a plurality of roller segments connected to each other by universal joints. Jack screws may be included to vary the spacing between the segments of the roller assembly and the guideway. Preferably, first and second axles are provided at the ends of the guideway, with each axle having a pulley set around which the first and second belts are supported, with the first axle driven by a motor. A frame supports the guideway and idler pulleys spaced along the underside of the guideway for supporting the moving belts.

Most desirably the guideway has two spaced apart side channels along the guideway base and a center channel in between the side channels at the guideway peak, with side belts running along the side channels and with a center belt running faster than the side belts, along the center channel. An embodiment having five belts, i.e., pairs of lower and middle belts, and a top belt, provides improved performance. A washing system can periodically automatically clean the fruit sizer.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
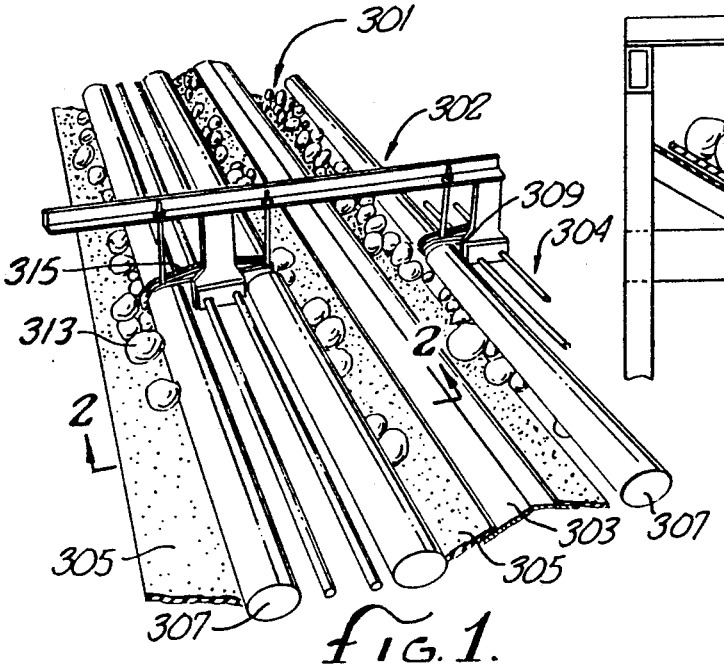
FIG. 1. PRIOR ART
FIG. 1 is a perspective view fragment of a prior art fruit sizer.
Figure 2:
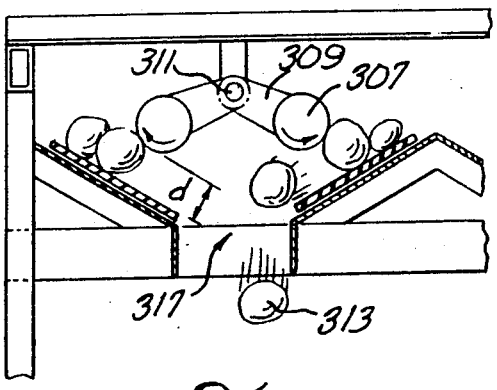
FIG. 2. PRIOR ART
FIG. 2 is a schematically illustrated section view fragment of the prior art fruit sizer of FIG. 1.

The prior art fruit sizer 301, as shown in FIG. 1 and 2, includes a belt platform 303 and flat conveyor belts 305. Spaced above the belts 305 are rollers 307 which rotate in the direction as shown by the arrows in FIG. 2 tending to push or roll the fruit up the incline of the conveyor belts 305. The rollers 307 are supported on pivot arms 311 which, in operation, are fixed in position within each sizing station 302, 304, etc., such that a fixed opening "d" (the sizing dimension) is established between the belts 305 and the rollers 307. The dimension "d" is gradually increased in each progressive sizer station 302, 304, etc., and it determines the size of fruit to be sorted within each sizer station.

As the fruit 313 is conveyed forward on the belts 305, it eventually reaches a sizer station wherein the dimension "d" is sufficiently large for the fruit to pass under the rollers 307 into the chute 317. It is then conveyed to juice extractors set up to extract juice from fruit in a specific ("d" sized) range of size. With this known fruit sizer, the rollers 307 within each sizer station 302, 304 are individually driven by roller drive mechanisms 315. Consequently with a sizer having, for example, 10 sizing stations and 6 sizing lanes or runs (each lane including one belt 305 and one roller 307 in between adjacent belt platforms 303) as many as 60 or more individual roller drive mechanisms 315 may be required.

Figure 3:
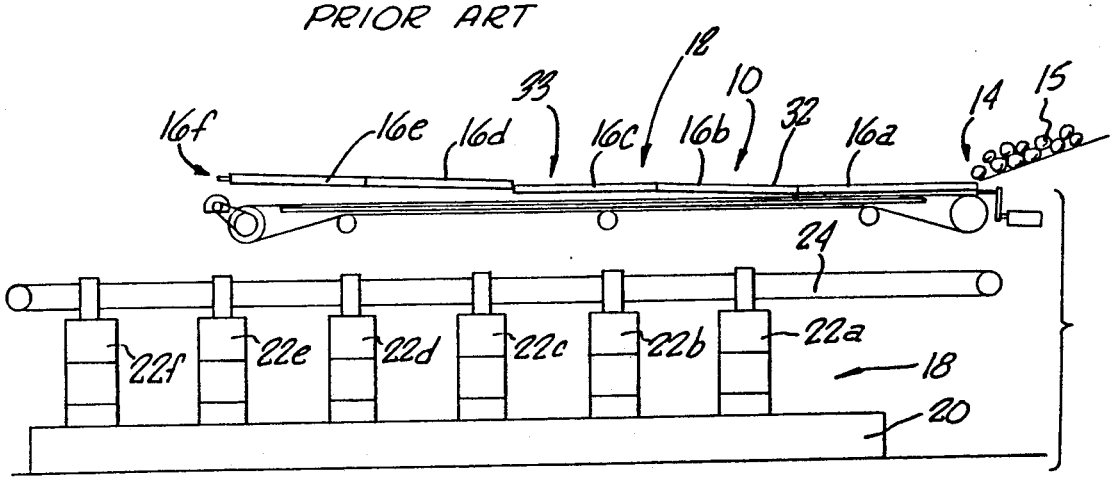
FIG. 3 is a schematically illustrated side view of the present fruit sizer installed above a line of juice extractors.

As shown in FIG. 3, the present fruit sizer 12 is typically used in a fruit juice extractor installation 10 and is positioned above an extractor unit 18 mounted on a platform 20. A fruit feed chute 14 supplies fruit 15 to the fruit sizer 12. The fruit sizer 12 has six sizer stations 16*a–f*, with each sizer station set up to allow fruit under a certain size "d" to pass through the fruit sizer 12 onto a distribution conveyer belt 24 on the extractor assembly 1B. Six juice extractors 22*a–f* are set up to receive sorted fruit from the corresponding sizer stations 16*a–f*. Of course, depending on the particular installation and type of fruit to be sorted, the number of sizer stations and corresponding extractors may vary. For example, if the extractors can perform well with a wide range of fruit size, then for example, only three or perhaps two sizer stations may be required. On the other hand, for certain applications 10 or more sizer stations may be used. Depending upon the capacity of the juice extractors (i.e., the number of fruit per minute or pounds per minute processed), two or more juice extractors may be associated with each sizer station.

Figure 4:
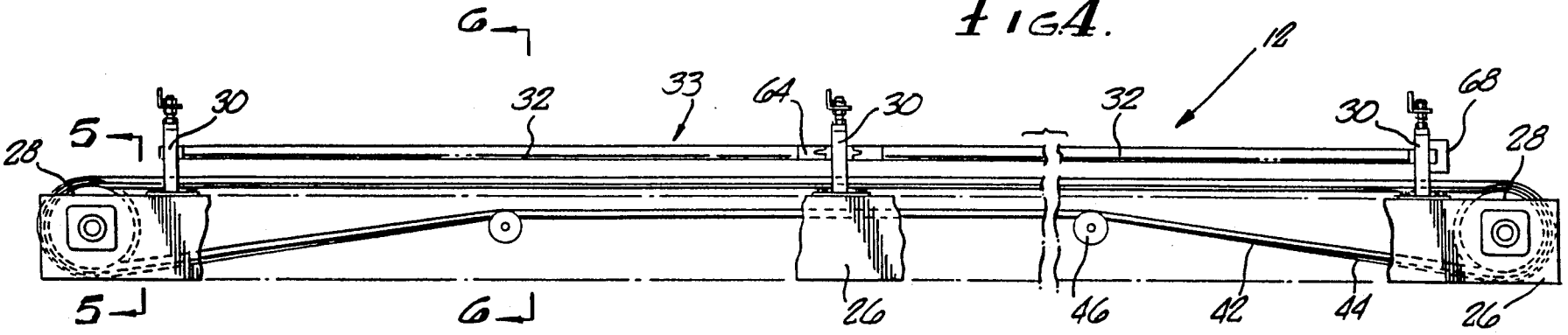
FIG. 4 is a compressed side view of the fruit sizer of the invention.
Figure 5:
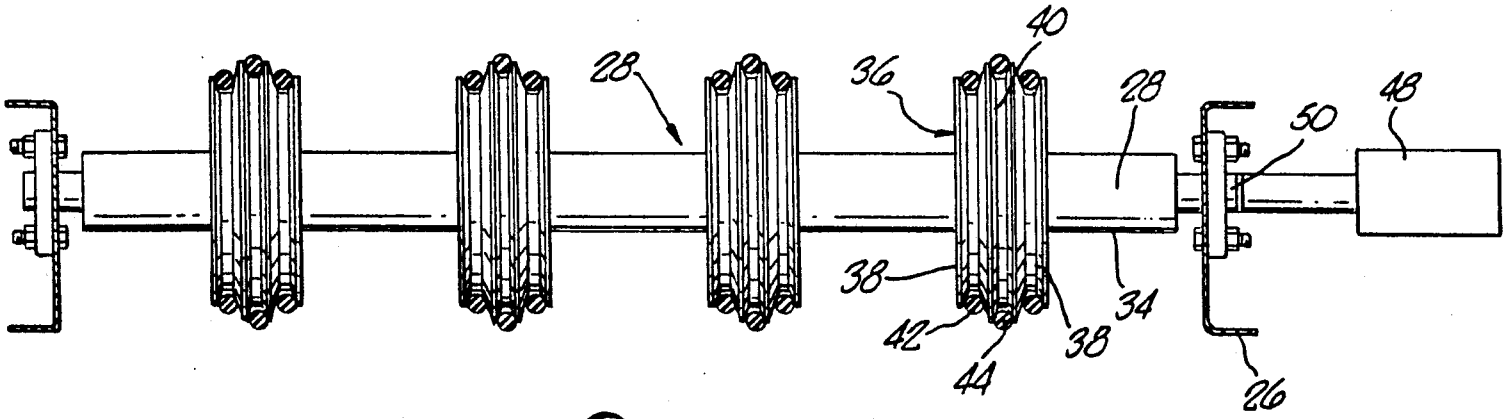
FIG. 5 is a section view taken along line 5—5 of FIG. 4.

With reference to FIGS. 4 and 5, the present fruit sizing apparatus 12 has a sizer frame 26 and axle assemblies 28 at each end of the sizer frame 26. The axle assemblies 28, as shown in FIG. 5, each include an axle 34 and at least one pulley assembly 36. At least one of the axles 34 of the axle assemblies 28 is joined to a drive motor 48 through a coupling 50. The pulley assemblies 36 have a center pulley 40 surrounded by two side pulleys 38 each of which has a smaller diameter than of the center pulley 40. A center belt 44 and two side belts 42 are supported over the center pulley 40 and side pulleys 38, respectively, with the center and side belts 42 and 44 extending in an endless loop substantially the full length of the sizer frame 26 between the two axle assemblies 28.

Referring once again to FIG. 4, idler pulleys 46 are provided on the under side of the sizer frame 26 to support the center and side belts 44 and 42 on their "return". Stanchions 30 are spaced apart on the sizer frame 26. In a fruit sizer having six sizer stations, seven stanchions would be provided. Fruit sizing rollers 32 are supported over the center and side belts 44 and 42, in between the stanchions 30 along the length of the sizer frame 26. The roller segments 32 are connected to each other by universal joints 64 at the stanchions 30 to form an in line roller assembly 33 which extends substantially the entire length of the frame 26. A roller driver 68 is disposed at one end of the sizer frame 26 for rotatably driving the roller assembly 33.

Figure 7:
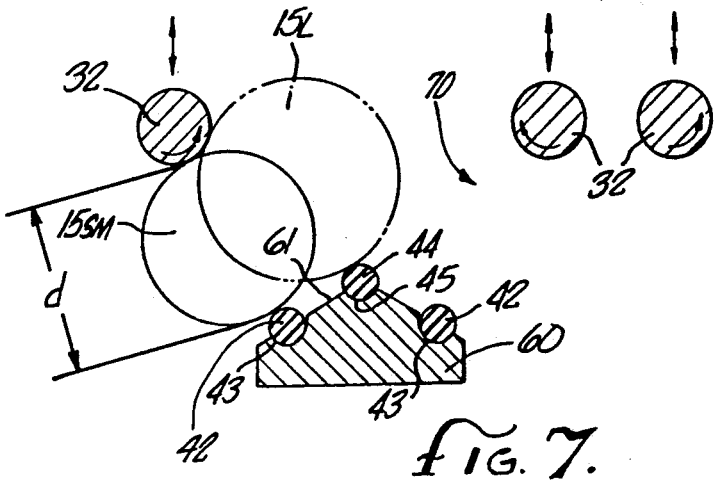
FIG. 7 is a schematic illustration of the operation of the fruit sizer of FIG. 4.

As shown in FIG. 3, certain roller segments 32 within each roller assembly 33 are set at a slight incline with respect to the guideway 60 and the belts 44 and 42 (FIG. 7) and form size transition regions. Other roller segments 32 are disposed parallel to the guideway 60 and the belts 42 and 44 (FIG. 7). The sizing opening "d" (FIG. 7) is smallest at the first sizing station 16*a* and increases intermittently along the length of the sizing apparatus 12. The fruit 15 is then sorted by size, with the smallest fruit 15 passing underneath the roller segments 32 in the first sizing station 16*a* and into a chute 72 (FIG. 6) with the remaining fruit progressively sorted by increasing size, in a similar manner. The largest fruit passes over the end of the sizing apparatus 12 into a chute and is in effect sorted (by process of elimination of smaller fruit) without passing under a roller segment. The chutes 72 lead to the juice extractor 22 associated with the particular sizing station.

Figure 6:
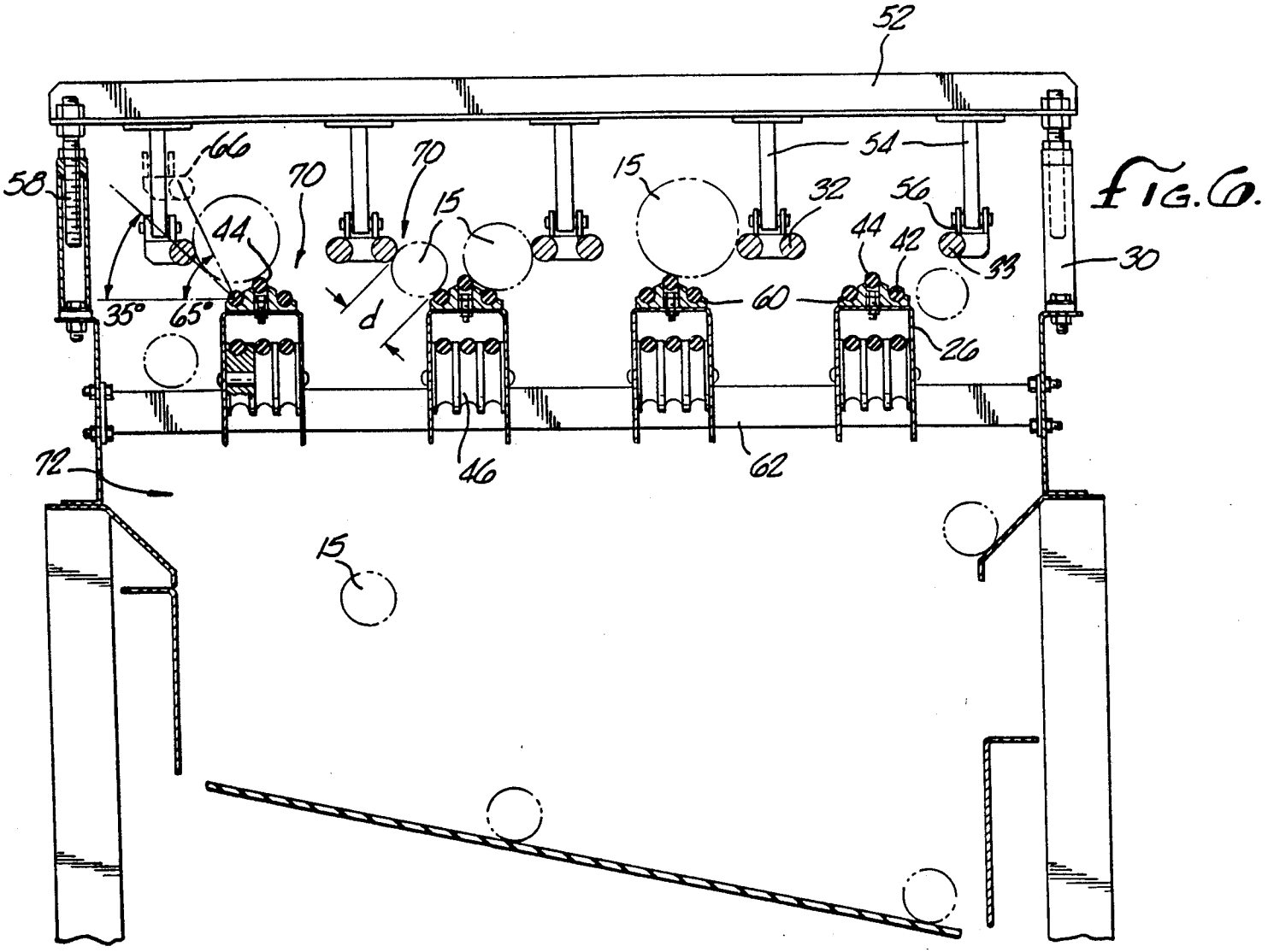
FIG. 6 is a section view taken along line 6—6 of FIG. 4.

As illustrated in FIG. 6, a crossbar 52 is suspended across a set of 8 sizer lanes 70. Hangers 54 within each lane 70 are suspended from the crossbar 52 and support bearing blocks 56 which hold the roller segments 32 in position. Within the stanchions 30 are crossbar jacks 58 which can be turned to raise or lower the crossbar 52 and thereby adjust the dimension "d" which determines the size of fruit which the sizer station will pass or sort.

A lower cross beam 62 spans the width of the fruit sizer 12 and supports four guideway supports 26. On top of each U-shaped guideway support 26 is a guideway 60 having inclined sides 61 (FIG. 7) and two semi-circular side channels or grooves 43 (FIG. 7) on either side of a semi-circular center channel 45 (FIG. 7). The side belts 42 generally move partially within the side channels 43 and the center belt 44 moves partially within the center channel 45. The guideway 60 is preferably ultra high molecular weight polyethylene or some other low friction material to facilitate sliding between the belts 42 and 44 and the guideway 60. The belts 42 and 44 are preferably made of urethane and are approximately ¾ inch in diameter.

FIG. 6 illustrates an installation having 8 lanes, with each lane or run 70 including a center belt 44, 1 side belt 42 and 1 roller assembly 33. The center belt 44 is shared between two lanes 70. In principle, the fruit sizer 12 can also operate with just a single side belt 42, a center belt 44 and a roller assembly 33, i.e., in a single lane configuration. However, with the dual lanes sharing a common center belt 44 as shown in FIG. 6, an advantageous interlane interaction of fruit movement is obtained.

As shown in FIG. 6, the rollers 66 are adjustable from a lowest position (shown in solid lines) in FIG. 6 wherein the roller 66 is elevated above the side belt 42 by a minimum angle of approximately 35°. With the roller 66 in its highest position (as shown in phantom line in FIG. 6), the roller 66 is elevated from the side belt 42 by an angle of approximately 65°. The position of the roller 66 above and to the side of the side belt 44 places the majority of the fruit moment on the belt and substantially reduces the crushing force on the fruit as it is sorted. This configuration is critical to the performance of the fruit sizing apparatus in accurately sorting fruit by size without crushing or damaging the fruit.

The lower the angle of elevation of the roller above the lower belts, the higher the compressive force applied to the fruit during sizing. For example, if the roller and belt are horizontally opposed, the compressive force on the fruit is theoretically infinite. Of course, in reality, the fruit deforms resulting in inaccurate sizing and passes through the gap between the roller and belt. By way of a second example, if the roller 66 were inclined at 5° relative to the belt 44, the compressive force on the fruit would be approximately 11½ times the fruit's weight. A soft orange weighing ½ pound would undergo almost 6 pounds of compressive force during sizing. Such a fruit would probably deform ½ inch and therefore be mis-sized by that amount.

The belts 44 are urethane and the guideways are ultra-high molecular weight polyethylene. The belts nest within the grooves in the guideways. This prevents lateral yield of the belts during sizing. However, since the rollers are above the belts, the compressive force on the fruit is limited so that the fruit is not crushed and so that it is sorted accordingly to its true size. The urethane belt is substantially incompressible, meaning that it is not significantly compressed by the weight or impact of the fruit during sizing, although it is flexible enough to wrap around the pulleys.

As shown in FIG. 7, the roller segments 32 within each lane 70 rotate in the direction tending to roll the fruit 15 up the inclined surfaces 61 of the guideway 60. Although FIG. 7 and the other Figures illustrate generally spherical fruit, the present apparatus can also sort oblong fruit such as lemons, which oblong fruit is sorted by its smaller diameter.

In operation, fruit 15 is channelled by a fruit feed chute 14 into the sizer lanes 70. The fruit settles within each lane such that each piece is at least momentarily supported by a roller segment 32 and a center belt 44 or a side belt 42. The center belt 44 moves at a speed faster than that of the side belts 42. The different speeds of belt movement and the rolling action of the roller segment 32 cause the fruit to be rapidly and accurately sorted within each lane 70 with only a relatively short length of travel. As shown in FIG. 7, larger fruit 15L contacts the faster moving center belt 44. This moves the larger fruit 15L along faster than the smaller fruit 15SM which creates agitation, frees up the smaller fruit 15SM so that it may drop through the opening "d" and speeds the larger fruit 15L to larger size sizing stations. In addition, the kinematics of the present fruit sizing apparatus causes clusters of fruit, and especially "sandwiched" small fruit surrounded by larger fruit, to separate so that small fruit are not carried forward beyond their proper sizing station.

The center belt 44 preferably is driven at approximately 300 feet per minute and the ratio of the speed of the center belt 44 to that of the side belts 42 should be in the range of 1.1 to 1.9. At higher speeds of the center belt 44, e.g., at a ratio of 2, "overrun" of the sizing stations increases.

One advantage of the present invention in comparison to existing fruit sizers is that the movement of the belts 44 and 42 causes the fruit 15 to advantageously settle within the runs 70 very quickly, so that the length of the fruit sizer 12 may be reduced. In addition, since flat belts are not utilized, the width of the fruit sizer may be reduced by as much as 50% or more making the present sizer more compact. By connecting the roller segments 32 of the roller assemblies 33 with U-joints, the large number of driver units previously required is significantly reduced. For example, an 8 run fruit sizer requires only a single motor 68 and a drive chain turning a sprocket on each roller assembly 33 in comparison to as many as 40 drive units required in the prior art apparatus. In addition, the universal joints also facilitate more simple and rapid adjustment of the sizing dimensions "d" implemented by raising or lowering the roller assemblies 33.

The relatively open structure and compact size of the present apparatus also permits rapid and easy cleaning, with the required cleaning time reduced by as much as one-half. Furthermore, since the present sizer has an open structure, and is relatively narrow, it may be accessed for cleaning purposes from a single cat-walk along its length on one side only, rather than on both sides as has previously been required.

Figure 8:
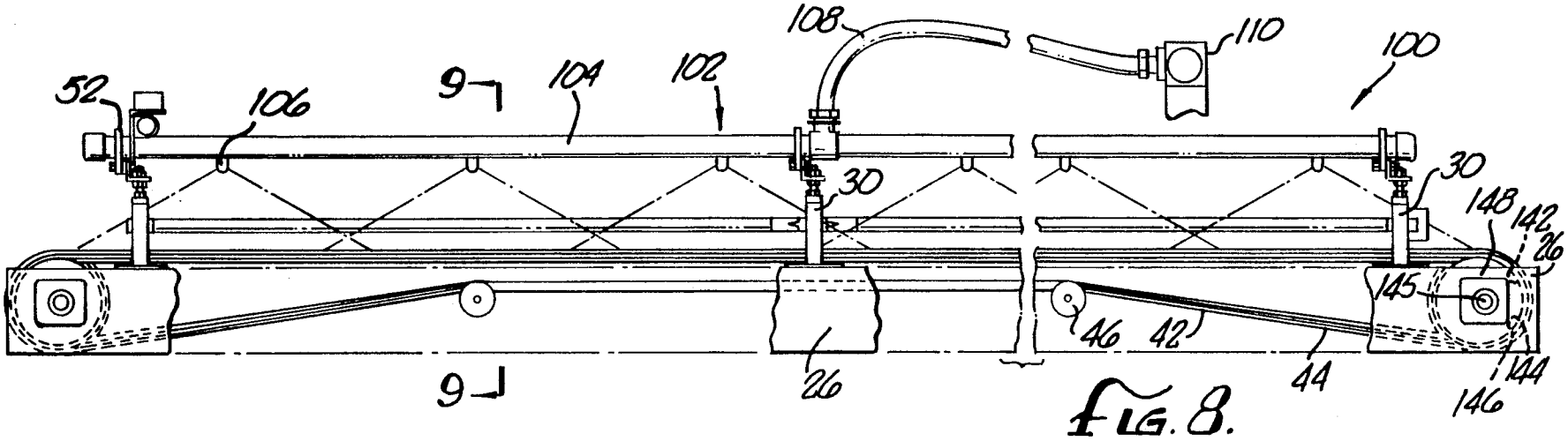
FIG. 8 is a side elevation view of a second embodiment having five belts, and provided with a sizer washing system.
Figure 10:
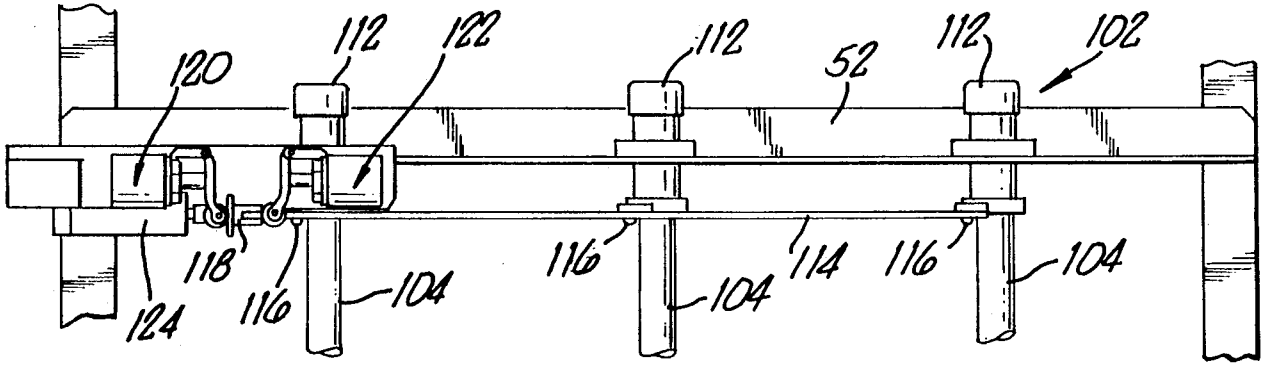
FIG. 10 is a top view fragment thereof.
Figure 9:
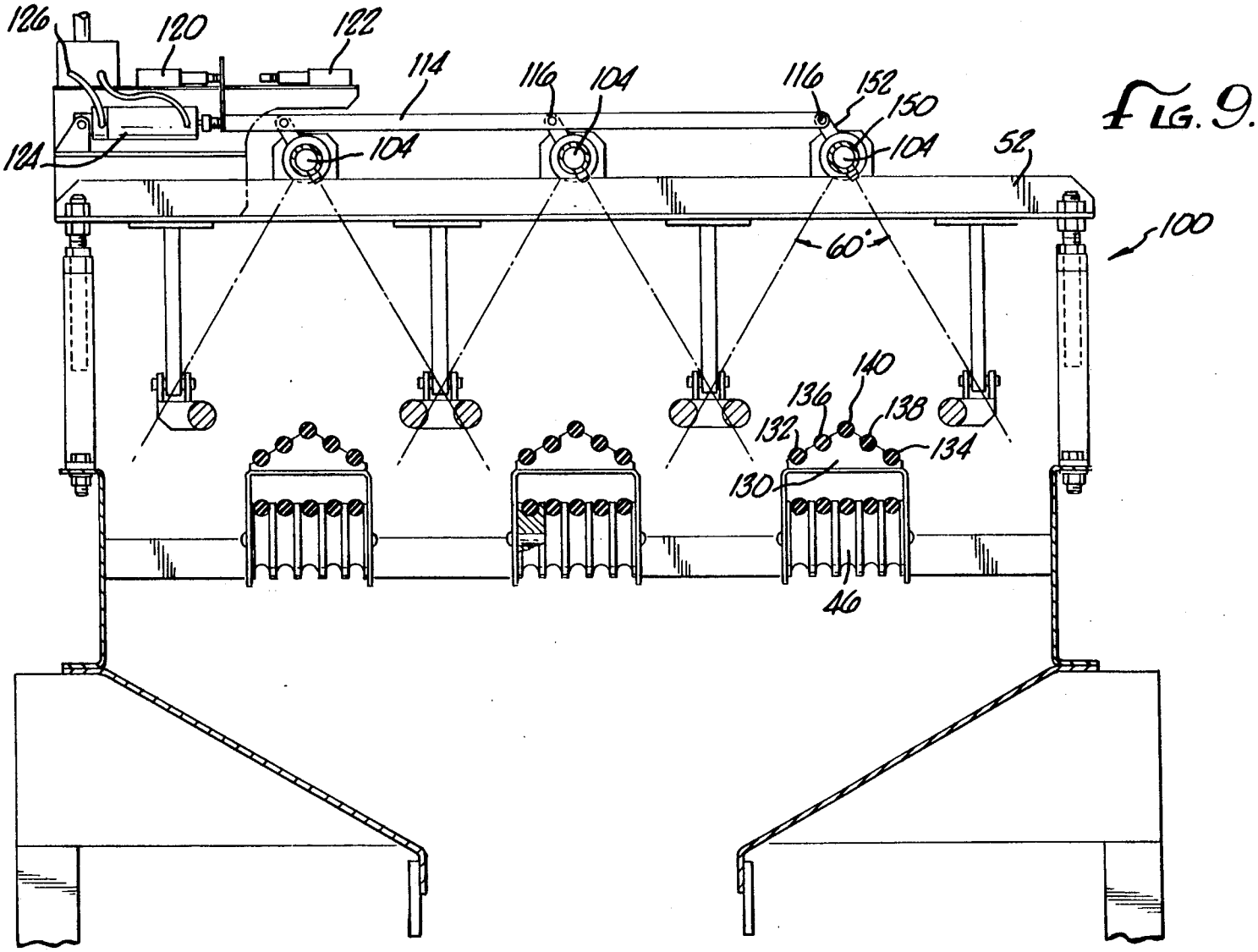
FIG. 9 is a section view thereof taken along line 9—9 of FIG. 8.

FIGS. 8, 9 and 10 illustrate a second embodiment 100 which includes a washing system 102. As shown in FIG. 9, in the second embodiment 100, a guideway 130 supports five belts 132, 134, 136, 138, and 140, rather than the three belts as shown in FIG. 7. The guideway 130 has a top or center groove, a pair of middle grooves straddling the top groove, and a pair of bottom grooves straddling the middle grooves, for supporting the top belt, middle and bottom belts, respectively. The center belt 140 is driven around a center pulley 146 (FIG. 8). The two middle belts 136 and 138 are driven over middle pulleys 144. Similarly, the side belts 132 and 134 are driven over side pulleys 142. A pair of rollers is positioned vertically above the top belt and straddling the bottom belts, i.e., the bottom belts 132 and 134 are below and in between the rollers, as shown in FIG. 9. The two side pulleys 142, the two middle pulleys 144, and the single center pulley 146, are mounted on an axle assembly 145 in a manner similar to the axle assembly 28 shown in FIG. 5. Consequently, the belts move at three different and decreasing linear speeds in the sizer 100, with the center belt 140 being the fastest and the side belts 132, 134 being the slowest. This five belt arrangement of the fruit sizer 100 provides three speed differentials, rather than the two differentials of the embodiment of FIGS. 3–7. The sizer 100 therefore provides additional agitation of the fruit mass to rapidly position a piece of fruit adjacent to a sizing roller for quick sizing. The five belt arrangement in the sizer 100 also provides a 66% increase in "live" surface over the three belt embodiment of FIGS. 3–7. This increase helps move and spread the fruit longitudinally along the length of the sizer to rapidly bring the fruit into sizing position.

The five belt arrangement of FIGS. 8 and 9 also has the ability to handle a larger range of fruit size, in comparison to the three belt embodiment. The five belt embodiment will size fruit from 2½ inch diameter to 5-inch diameter, and will pass up to a 9-inch diameter fruit over the end. (9 inch diameter grapefruit do occasionally show up, although they have virtually no juice value).

A washing system 102 is shown installed on the second embodiment 100, as shown in FIGS. 8, 9 and 10. As shown in FIG. 8, a water manifold 110 is linked by hoses 108 to supply pipes 104 pivotally supported on the crossbars 52. As shown in FIG. 9, the supply pipes 104 are generally laterally aligned with the center belts 104 in each run. Fan nozzles 106 are provided at longitudinally spaced increments along the length of the supply pipe 104. The fan nozzles 106 are spaced apart such that their projected flat fan-like sprays of water overlap, as illustrated in FIG. 8.

As shown in FIG. 9, the supply pipes 104 are pivotally mounted on the crossbars 52 through bushings 150. A drive link 114 is pivotally connected to each supply pipe 104 through a pivot pin 116 connected to a mounting tab 152 attached to the supply pipe 104. As shown in FIGS. 9 and 10, the link 114 is attached to a pneumatic actuator 124 which alternately drives the link 114 in a back and forth movement, as controlled by limit switches 120 and 122. A valve 126 controls air flow to the pnematic actuator 124. The alternating movement of the link 114, as driven by the pneumatic actuator 124 causes the ganged supply pipes 104 to pivot through a sweep angle of approximately 60°. This allows the spray from the fan nozzles 106 to sweep over the rollers, belts and guideways to perform a cleaning function. The cleaning operation is typically run during the clean up of the juice line and can be performed in a fraction of the time required to clean the sizer of prior art. The washing system can also be utilized with a three-belt sizer.

While embodiments and applications of this invention have been shown and described, it would be apparent to those skilled in the art that many more modifications are possible without departing from the inventive concepts herein. The invention therefore, is not to be restricted except in the spirit of the appended claims.

We claim:

1. An apparatus for sorting generally round fruit by size by allowing the fruit to move, at least in part, by force of gravity vertically downwardly through the apparatus, comprising:

a guideway having a top groove, a pair of middle grooves disposed below and straddling the top groove, and a pair of bottom grooves disposed below and straddling the middle grooves;

a top belt supported in the top groove of the guideway;

a pair of middle belts supported in the middle grooves in the guideway;

a pair of bottom belts supported in the bottom grooves in the guideway;

a pair of rollers positioned vertically above the top belt and straddling the bottom belts; and means for driving the middle belts linearly faster than the bottom belts;

means for driving the top belt linearly faster than the middle belts.

* * * * *